United States Patent [19]

Herrell

[11] 4,042,205

[45] Aug. 16, 1977

[54] MOLD ELEMENT FOR HORIZONTALLY FORMING PANELS

[76] Inventor: Flavel Deloyd Herrell, 2310 S. Cathy, Tucson, Ariz. 85710

[21] Appl. No.: 638,624

[22] Filed: Dec. 8, 1975

[51] Int. Cl.[2] ..... B28B 7/22

[52] U.S. Cl. ..... 249/189; 249/219 R

[58] Field of Search ..... 249/13, 18, 129, 131, 249/139, 158, 160, 166, 188, 189, 207, 210, 219 R; 52/546, 593, 595

[56] References Cited

U.S. PATENT DOCUMENTS

| | | | |
|---|---|---|---|
| 1,383,161 | 6/1921 | Spalding | 249/189 |
| 2,317,428 | 4/1943 | Anderson | 52/593 |
| 2,940,152 | 6/1960 | Riehl | 249/188 |
| 3,722,849 | 3/1973 | Luyben | 249/219 R |
| 3,782,680 | 1/1974 | Hopkins | 249/188 |
| 3,810,601 | 5/1974 | Miram | 249/188 |
| 3,822,858 | 7/1974 | Franklin | 249/210 |

FOREIGN PATENT DOCUMENTS

| | | | |
|---|---|---|---|
| 2,162,202 | 6/1973 | Germany | 249/188 |

*Primary Examiner*—Ronald J. Shore
*Assistant Examiner*—John McQuade
*Attorney, Agent, or Firm*—J. Michael McClanahan

[57] ABSTRACT

A method and apparatus for forming concrete wall panels used in tilt-up wall buildings comprising a grooved, truncated triangle shaped speed set double chamfer fixedly attached to the building floor, a side wall form adapted to nest within a groove formed in the speed set double chamfer, means attaching the side wall form to the double chamfer, and a second speed set double chamfer inverted over and fixedly attached to the wall form, the wall form nesting interior to the inverted groove of the speed set double chamfer. The concrete wall panel to be formed is poured into a form having the perimeter comprising the invention. When the concrete has set, the upper speed set double chamfer and side wall form is removed and the wall panel tilted up and emplaced.

15 Claims, 8 Drawing Figures

MOLD ELEMENT FOR HORIZONTALLY FORMING PANELS

BACKGROUND OF THE INVENTION

In the building construction field, a method of pouring concrete walls in a prone position has become popular where the concrete is permitted to set, then the wall is tilted up into position and a foundation poured to receive the wall, the foundation generally rising up above the edge of the wall to grasp the wall in a tongue and groove manner. To prepare a wall in this fashion, it is customary for the floor of the building being built to serve as a part of the form. Usually the floor is concrete and by its use, a flat panel may be made.

When the construction has progressed to the point where the floors of the building have been prepared and wall construction is to begin and the decision has been made to use the tilt-up type concrete walls, the usual procedure is to use a 2 × 8 or other appropriate piece of wood to form the side walls of the tilt-up panel to be poured. Obviously, as the panel will lay upon the floor of the building, a release or perhaps, plastic, is required to be laid on the floor to keep the concrete panel from adhering to the floor. The wood which is presently used is held to the floor by driving long spikes or concrete nails through the wood and into the concrete floor or, by drilling holes partially into the wood and then finishing with a concrete nail or similar device. Generally, the wood pieces are placed such that the smallest thickness rests on the concretefloor with the width of the board perpendicular to the floor, the width of the board serving to form the thickness of the wall panel to be poured.

Once the wood forms are attached to the floor by means of concrete nails or other means, then, alongthe interior bottom perimeter, i.e., next to the concrete floor is placed a chamfer. This chamfer is usually made of wood having a cross-sectional shape of an equilateral triangle with appropriate lengthed side arms. The chamfer is nailed to the wood form to hold it in place, or it could be nailed to the floor.

The chamfer is placed all the way around the bottom portion of the mold form. Then, a similar chamfer is attached to the perimeter of the form at the top of the wood side wall form by nailing to the wood side form. The wood forms must be attached to the floor as there is a tendency for the forms to float up as the concrete is poured into the cavity.

Thereafter, the concrete is poured into the form and permitted to set. After the concrete has set, the upper chamfer is removed with a crowbar or other type of device, and in the process, is destroyed beyond reuse. Similarly, the wood form is destroyed in removing to obtain access to the wall panels. The wall panel is then lifted from the form and set in place as previously described.

As the forms are removed, large gaping holes are left in the concrete floor as rather large concrete nails or other fastening means, sometimes referred to as piston pins, are necessary to hold the wood side wall forms in place. These holes, of course must then be patched.

As evidenced from the above description, the process of constructing the forms is a lengthy process requiringa long period of work time by a carpenter and as is usually the case, the forms are not reusable.

SUMMARY OF THE INVENTION

The present invention comprises apparatus for accomplishing the construction of forms to be used in forming concrete tilt-up wall panels, doing so without destroying the forms, and thus rendering the forms reusable.

More specifically, the present invention comprises a grooved, truncated triangle shaped speed set double chamfer which may be easily constructed, such as by extrusion methods. Materials which have been tried have been aluminum and polyethylene plastics. The invention comprises a flat base plate, one side of which is adapted to rest upon the concrete floor of the building, with the other side having a pair of right triangles formed thereon, the hypotenuse of which triangles forming the chamfer side with the right angles of the triangles, together with one of the equilateral sides, constituting a groove opposite the flat side.

The speed set double chamfer is nailed to the floor with concrete nails or piston pins, i.e., small nail-like projectors which are shot from a gun into the concrete. The concrete nail also penetrates a thin metal strap which also rests in the grooves, the strap being placed at various positions along the double chamfer. A wood wall form, i.e., a wood plank, having a width related to the thickness of the wall desired, is set in the groove of the double chamfer and the thin metal strip tacked to its sides. Then a second double chamfer is inverted on the top portion of the wood wall form with a small nail running through the chamfer base into the wood to hold it in place.

The wall is poured and when set, the small nails holding the upper chamfer are pulled out releasing the upper double chamfer for reuse. Thereafter, the wall is removed from the form and set in place, however, it may be necessary to remove the pieces of wood serving as side walls for the form in order to remove the panel.

Thereafter, the forms can be reused in place by replacing the upper double chamfer, or if necessary, the wood pieces back into the grooves and renailing the upper double chamfer to the wood form upper edge. When all the tilt-up panels have been prepared, then all that need be removed are the nails or piston pins holding the bottom speed set double chamfer to the floor. Then the double chamfer is removed for storage or reused in another location.

As can be seen, the subject invention provides speedy means of forming wall panels for tilt-up operations having qualities of reusability and requiring a minimum set-up work time. Additionally, the concrete nails or piston pins or other means used to fasten the invention to the floor are smaller in size than those formerly used and as a result a fewer number and smaller size hole are left in the floor of the building which, of course must be patched.

Accordingly, it is an object of the present invention to provide apparatus to construct forms for a tilt-up concrete panel used in building construction.

Another object of the invention is to provide reusable forms which may be used to construct tilt-up concrete panels.

A still further object of the invention is to provide means to construct tilt-up concrete panels with a minimum of work time required.

DESCRIPTION OF THE PREFERRED EMBODIMENT

Figure 1:
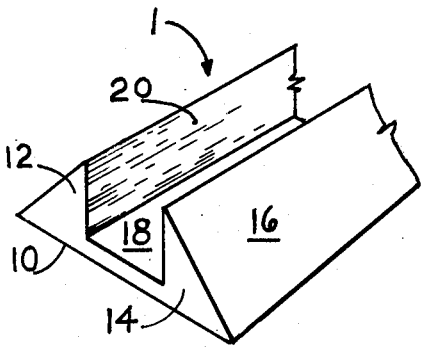
FIG. 1 is perspective view of the subject invention in its preferred embodiment.

As shown in FIG. 1, the embodiment of this invention for improving the method of forming concrete wall panels used in tilt-up wall buildings comprises the basic speed set double chamfer 1 having base plate 10 upon which are situate the triangle shaped sections 12 and 14. The hypotenuse of the triangle shaped sections12 and 14 comprise the chamfer surfaces 16 and 15 (FIG. 2) respectively. The triangles 12 and 14 are right triangles with the adjacent sides of the triangles forming the walls of the groove which is central to the speed set double chamfer. Specifically, the central groove comprises floor 18 with side wall 20 formed by the adjacent side of right triangle 12 and side wall 22 (FIG. 2) formed by the adjacent side of right triangle 14. As mentioned earlier, walls 20 and 22 are perpendicular to floor 18. Floor 18 in turn is parallel to the base plate 10.

In operation, the groove formed by floor 18 and walls 20 annd 22 is adapted to receive a piece of wood or similar material which serves as the side wall of the tilt-up panel form. Additionally, the right triangles 12 and 14 shown in the preferred embodiment are equilateral triangles, i.e., equal sides connecting the right angle and having 45 degree angles in the angle opposite each equal side, although the invention is not limited to equilateral triangle shaped sections.

It is proposed that in the most economical manufacture, the speed set double chamfer be extruded from polyethylene plastic or similar type plastic, or from metal such as aluminum. In this manner, the desired lengths may be cut as the invention is continuously extruded.

Figure 2:
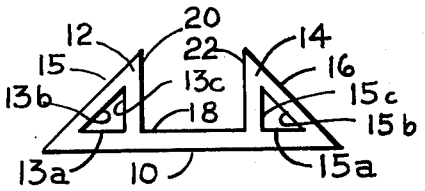
FIG. 2 is an end view of an alternate embodiment of the invention.

Referring now to FIG. 2, a cross section end view of an alternate embodiment of the subject speed set double chamfer is shown where, in order to reduce costs of material without substantial sacrifice of strength, a second triangle has been cut interiorly to each of the triangles 12 and 14 which forms the chamfer surfaces 16 and 15 and the groove side walls 20 and 22. The triangle which has been formed centrally to the aforementioned triangle comprises sides 13*a*, 13*b* and 13*c* of triangle 12 and 15*a*, 15*b*, and 15*c* of triangle 14. Obviously, by forming these central triangles, the amount of materials used is reduced.

Figure 3:
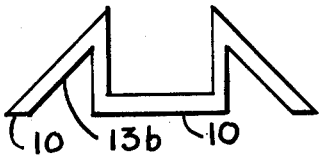
FIG. 3 is an end view of a second alternate embodiment of the invention.

FIG. 3 illustrates a second embodiment of the preferred invention speed set double chamfer where, in addition to removing the triangle shaped central portion of triangles 12 and 14 the material forming the base 10 directly beneath the sides 13*a* and 15*a* of the inner triangles has been removed to base 10. This construction obviously will conserve even more material. The remainder of the invention remains the same as can be seen in FIG. 3.

Figure 4:
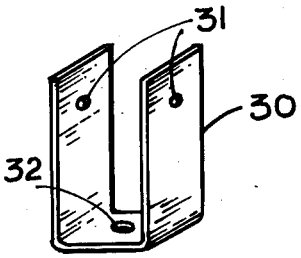
FIG. 4 is a perspective view of the holding strip utilized in the subject invention.

Referring now to FIG. 4, the strips of metal or other suitable material is shown which holds the wood plank in nesting relationship in the groove formed in the speed set double chamfer to prevent the wood plank from floating up when the wall panel is formed is indicated by number 30. As can be seen, the strip merely conforms to the shape of the groove and the bottom edge of the associated wood plank. Also shown in FIG. 4 are three holes which have been punched through holding strip 30, namely holes 31 and hole 32. Holes 31 accommodate a nail which is driven into the side wall wood plank in order to hold the wood plank to the holding strip. Hole 32 permits a nail to be driven through the holding strip 30 into and through floor 18 of the speed set double chamfer for penetration into the concrete floor.

Figure 4A:
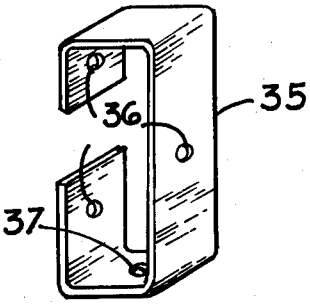
FIG. 4A is an alternate embodiment of the holding strip utilized in the subject invention.

FIG. 4A illustrates an alternate embodiment of the holding strip comprising a similar metallic or other sufficiently strong material 35 having holes 36 to receive nails to hold the associated wood plank in place and hole 37 corresponding to hole 32 in FIG. 4. Again, a nail or piston pin is driven through hole 37 into and through floor 18 of the speed set double chamfer and into the building floor upon which the base of the speed set double chamfer rests.

Figure 5:
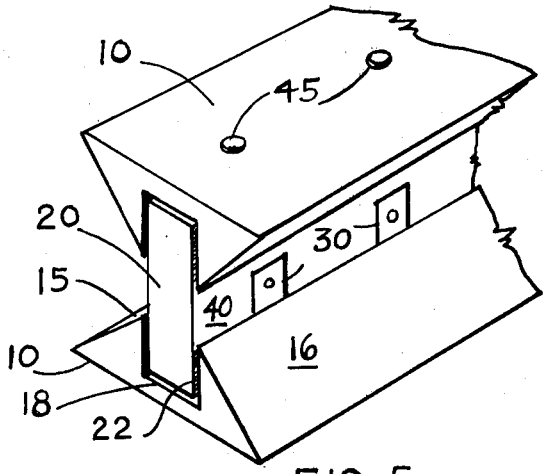
FIG. 5 is a perspective view of the preferred embodiment of the invention as the invention will be utilized.

FIG. 5 illustrates the assembled invention showing how the speed set double chamfer is utilized together with the wood plank to comprise the form for the panel which is poured upon the concrete floor of a building. The form runs around the perimeter of the tilt-up concrete panel. Referring specifically to the parts of the invention shown in FIG. 5, it can be seen that the speed-set double chamfer is utilized in two positions, the first on the floor of a flat surface, such as the concrete floor of the building upon which the tilt-up panels are poured. This lower double chamfer comprises the chamfer surface 16 which engages the concrete, the opposite chamfer surface 15 for another tilt-up wall panel to be formed, and holding strip 30 attached to the wood plank 40.

Also, as can be seen in FIG. 5, the wood plank 40 nests in the groove formed by walls 20 and 22 and floor 18. In construction, and in order of assembly, the speed set double chamfer which comprises the lower portion of the concrete form is attached to the concrete floor, or other type of floor, of the building for which the tilt-up wall panels are being made. As described earlier in the background of the invention, the building floor serves as one portion of the form for pouring the concrete tilt-up panels. The speed set double chamfer which attaches to the floor of the building is laid out in the shape which the panel is going to take and is firmly attached to the floor by a nail, concrete nail, or piston pin, and firmly held in place. As a general rule, the nails, or whatever means are used to hold the speed set double chamfer in place, for best results, are situated such that the head of the nail or pin rises slightly above the floor 18 of the speed set double chamfer. This is done in order that when it is desired that the double chamfer be removed from the floor of the building, there are means by which to pull the nail or pin out by its head.

Next, the holding strips are assembled in the groove formed in the speed set double chamfer by driving nails, concrete nails, piston pins, or other similar device through the hole 32 (FIG. 4). This firmly attaches the holding strip to the lower double chamfer. It is obvious that in order to reduce the number of holes that will eventually end up in the floor of the building, which is one of the purposes of the invention, one may utilize the same nail, concrete nail, or piston pin to hold the holding strip in place as holds the speed set double chamfer in place. The pins or devices holding the double chamfer in place are placed at regular intervals as deemed necessary by the construction.

Next, wood plank 40, which nests in the groove formed in the speed set double chamfer is put in place. The wood plank is driven down in place over the heads of the pins protruding above floor 18 permitting them to penetrate the relatively soft wood of the wood plank 40 so the wood plank lies flat on the floor 18 of the groove.

It is noted that the nails, pins, or other holding device which is used to secure the double chamfer to the building floor are preferably of the type which have double heads, i.e., have a first head which would stop the penetration of the nail into the double chamfer and then a second head a small distance above that. The second head permits the nail to be held by a claw hammer or claw bar when pulling the nail or pin out of the building floor. After the wood plank 40 or other similar device which is used to form a portion of the concrete form has been emplaced, a second speed set double chamfer is inverted over the wood plank 40 to form the upper portions of the concrete tilt-up panel form. Again, as in the first instance, the wood plank nests in the groove of the double chamfer and then finally, the upper double chamfer is secured by means of nails which are driven from the base 10 through the floor 18 of the groove and into the wood plank 40. The nails are shown as number 45. These nails are spaced out at regular intervals as deemed desirable. With the addition of the upper inverted speed set double chamfer the construction of the form into which the concrete is poured to prepare the tilt-up panel is completed.

As is evident from FIG. 5, the thickness of the wall panel formed is equal to the sum of the distance between the floor 18 and the base 10 of the speed set double chamfer (times 2) plus the width of the wood plank 40. Inasmuch as a standard double chamfer is desirable from manufacturing considerations, and consequently the floor base thickness remains the same, the thickness of the wall panel is directly related to the width of the wood plank 40.

It is noted that from the design of the speed set double chamfer and as shown in FIG. 5, the consonant with the present practice in construction of the tilt-up concrete panels, more than one panel is prepared at a time. In fact, the panels, in preparation, will lie adjacent to each other and to the invention as described in FIGS. 1–5 anticipates this situation. The form which has been illustrated is for the preparation of two simultaneous panels on opposite sides of the wood plank 40, which is also the reason the invention has two opposite chamfer surfaces.

Figure 6:
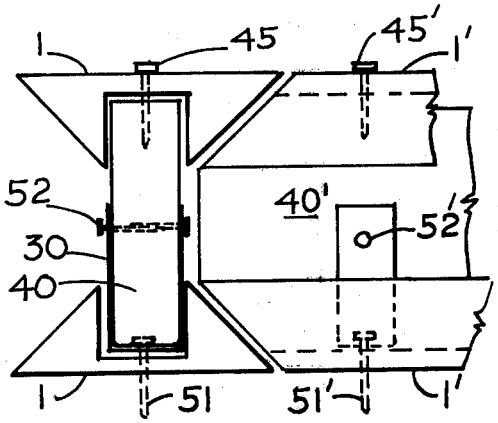
FIG. 6 is an end view of the preferred embodiment of the invention in place showing a cross member of the form utilizing the invention.

Referring now to FIG. 6, a cross section of the subject invention is shown in form position near the intersection of another similarly constructed form joining the member shown in cross section at a 90° angle to comprise one corner of the basic tilt-up panel concrete form.

As can be seen in FIG. 6, which is exaggerated with respect to the parts nesting relationship, there is shown the fitting or connectional relationship between the form members joining at right angles. On the joining perpendicular member, wood plank 40' abuts wood plank 40 and the upper and lower speed set double chamfer 1' are cut at angles so that they nest under and above the chamfer surfaces of the speed set double chamfer 1 shown in cross sections.

Also shown in FIG. 6 are the nails, concrete nails, or piston pins 51 and 51' which, as can be seen, have their head rising above the floor 18 of the double chamfer with their point penetrating into the building floor. Also shown in FIG. 6 are the common nails 52 and 52', together with nails 45 and 45' which hold the total assembly together in order that the wood plank and the upper double chamfer will not float up when the concrete fills the cavity formed.

The nail 45 which hold the upper speed set double chamfer to the central wood plank 40 are contemplated as being single headed nails driven down flush with top surface 10. The reason for this is that concrete is poured into the molds or forms until it reaches the top of the upper surface 10. Then the total surface is smoothed in that position. It obviously would be a hindrance to the concrete finisher to have the nail head sticking up above the overall flat surface which is desired.

Figure 7:
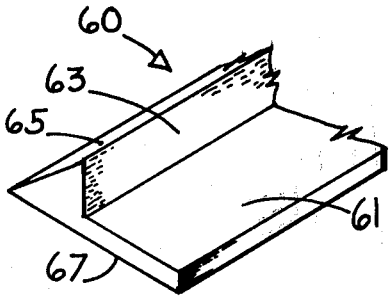
FIG. 7 is an alternate embodiment of the subject invention.

Referring now to FIG. 7, a speed set single chamfer is shown where, similarly to the double chamfer shown in FIG. 1, one of the triangles whose hypotenuse forms a chamfer surface has been eliminated. The remainder of the speed set single chamfer remains the same, the former floor surface of the groove having expanded out to form an apron 61. The remaining portion comprises wall 63 rising perpendicular from the apron 61, chamfer surface 65 of the one remaining triangle, and base 67, the edge of which is shown in FIG. 7.

In use, the speed set single chamfer is similarly employed as the double chamfer with the exception that it is only used when panels are not poured in tandem, i.e., there is only one panel to be poured. The speed set single chamfer is similarly nailed in place as is the double chamfer with the possible addition of reinforcing upon the side of the wood plank opposite the triangle portion to hold the wood in place. This can be done with nails penetrating the wood and single chamfer apron at an angle.

A description of the invention together as it is employed in practice has been given above. Once the invention has been utilized to prepare the form for the concrete tilt-up panel and the concrete has been poured into the interior of the form, and allowed to set, and it is time to remove the tilt-up panel for emplacement as a building wall, the following procedure is utilized.

In removing the upper speed set double chamfer, the nail 45 will have to be withdrawn by means of a claw hammer or a claw bar. If that is not feasible due to the fact it is flush with surface 10, then a bar is put under the edge of the chamfer such as to lift it off the plank and withdrawing the nail with it. It is also noted that for best results, the material chosen for the speed set double chamfer is the type that has sufficient strength to lift the nail head, or, in the event that the nail head should pull through the floor of the double chamfer, the material is not brittle enough to break. Polyethylene plastic and/or aluminum are suitable for this purpose. Other types of materials exist, such as polyvinyl chloride plastic.

Once the nails 45 are removed, the upper inverted speed set double chamfer is lifted off the associated wood plank 40. At this point, the panels may be lifted out through the use of hook holding means imbedded in the concrete. It may be occasionally necessary to remove the side wall wood plank 40. In this event, it would be necessary to go to one open exposed side of the panels which have been poured in tandem. Then, the wood planks are pried up, pulling the bottom nail or piston pin 51 through the holding strip 30. The same applies to the other sides of the form which are not sandwiched between wall panels.

Once the wood planks are removed, then the panel may be tilted up and out. The lower speed set double chamfer then is removed by removing the holding pin. It is noted that if there is to be a tendency for the concrete to stick to the chamfer surface which joins the concrete, then a release may be applied first to the chamfer surface, although the materials chosen are usually not adhesive to concrete.

While a preferred embodiment together with alternate embodiments of the invention have been shown and described, it would be understood that there is no intent to limit the invention by such disclosure, but rather, it is intended to cover all modifications in alternate construction falling within the spirit and the scope of the invention as defined in the appended claims.

For example, while the preferred embodiment speed set double chamfer and speed set single chamfer have been described in terms of a single extruded assembly, it is obvious to one skilled in the art that these assemblies may be constructed having elongated base plates with the triangular shaped chamfers mounted thereupon at the appropriate places. Further, there is no mechanical necessity that the wood planks that comprise the side wall form be at right angles to the base of either the lower or upper speed set double chamfer or speed set single chamfer, but, may be at any acute angle with the triangular shaped chamfers heretofore described right angle being changed accordingly to accommodate the desired angle that one wishes upon the wall panel to be formed. This would of course present difficult, but not impassable, problems in removing the concrete wall panels.

I claim:

1. Apparatus for horizontally forming concrete wall panels for tilt-up wall buildings comprising a first elongated base plate means having at least one elongated triangular shaped cross-sectioned chamfer means attached thereto; a side wall form having a first end juxtaposed said first base plate means and one side of said elongated triangular chamfer means; a second elongated base plate means secured to the other end of said side wall form, said second elongated base plate means having at least one elongated triangular shaped cross-sectioned chamfer means attached thereto with one side of said triangular shaped chamfer means which is attached to said second base plate means juxtaposed said other end of said side wall form; and strap means fixedly attached to the first end of said side wall form; and pin-type fastening means including nail means securing said strap means to said first base plate means and said first base plate means to an associated floor, whereby said apparatus is arranged to form part of the wall panel perimeter.

2. The apparatus for forming concrete wall panels as defined in claim 1, wherein each said elongated base plate means and elongated each said chamfer means comprises polyethylene plastic.

3. The apparatus for forming concrete wall panels as defined in claim 1, wherein each said elongated base plate means and elongated each said chamfer means comprises metal means.

4. Apparatus for forming concrete wall panels for tilt-up wall buildings as defined in claim 1, wherein each said elongated base plate means and elongated chamfer means having a triangular shaped cross section attached thereto comprise one piece and are constructed by extrusion methods.

5. Apparatus for horizontally forming concrete wall panels for tilt-up wall buildings comprising a first elongated base plate means having two elongated triangular shaped cross-sectioned chamfer means attached thereto, one end of a side wall form juxtaposed said first base plate means between said chamfer means, a second elongated base plate means juxtaposed in secured fashion the other end of said side wall form, said second base plate means having two elongated chamfer means having a triangular shaped cross section attached thereto on opposite sides of said side wall form, and securing means attaching said side wall form to said first base plate means and said first base plate means to an associated floor whereby said apparatus comprises a part of a wall panel form perimeter of at least two adjacent wall panels to be constructed and whereby said side wall form may be removed from said first base plate means without removing said first base plate means from said associated floor.

6. Apparatus for forming concrete wall panels as defined in claim 5, wherein the respective triangular shaped chamfer means attached to each of said first and second base plate means are non-overlapping and distal each other on each said first and second respective base plate means.

7. The apparatus for forming concrete wall panels defined in claim 6, wherein the side wall form is juxtaposed sides of each said triangular shaped chamfer means.

8. Apparatus for forming concrete wall panels defined in claim 7, wherein both said triangular shaped chamfer means attached to each said base plate means comprises a right triangle having one side of each said right triangle perpendicular to the base plate means to which it is attached whereby a right angle groove is formed.

9. The apparatus for forming concrete wall panels defined in claim 8, wherein said means attaching said first base plate means to said associated floor comprises pin type fastening means including nail type fastening means.

10. The apparatus for forming concrete wall panels defined in claim 9, wherein said side wall form is secured to said first base plate means by strap means fixedly attached to said side wall form and said first base plate means.

11. The apparatus for forming concrete wall panels as defined in claim 9, wherein said side wall form nests in said right angle grooves formed by said sides of said right triangular shaped chamfer means.

12. The apparatus for forming concrete wall panels as defined in claim 11, wherein both said elongated base plate means and said attached elongated triangular shaped chamfer means comprise polyethylene plastic.

13. The apparatus for forming concrete wall panels defined in claim 11, wherein both said base plate means and said attached triangular shaped chamfer means comprise metal means.

14. The apparatus for forming concrete wall panels as defined in claim 8, wherein each said base plate means and said attached triangular shaped chamfer means comprise one piece and are constructed by extrusion methods.

15. Apparatus for forming concrete wall panels as defined in claim 1, wherein each said triangular shaped chamfer means attached to each said base plate means comprises a right triangle having one side of said right triangle perpendicular to said base plate means.

* * * * *